US007971383B2

(12) United States Patent
Fitzpatrick et al.

(10) Patent No.: US 7,971,383 B2
(45) **Date of Patent: *Jul. 5, 2011**

(54) RAIL COVER PANEL FOR A FIREARM

(75) Inventors: Richard Fitzpatrick, Longmont, CO (US); Michael T Mayberry, Denver, CO (US); Eric Christopher Burt, Broomfield, CO (US); Mike J Baranello, Denver, CO (US)

(73) Assignee: Magpul Industries Corporation, Boulder, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/978,153

(22) Filed: Dec. 23, 2010

(65) Prior Publication Data

US 2011/0099879 A1 May 5, 2011

Related U.S. Application Data

(63) Continuation of application No. 12/359,096, filed on Jan. 23, 2009, now Pat. No. 7,856,749.

(60) Provisional application No. 61/023,541, filed on Jan. 25, 2008.

(51) Int. Cl.
*F41A 35/04* (2006.01)

(52) U.S. Cl. ..... 42/96; 42/85; 42/90

(58) Field of Classification Search ..... 42/72, 85, 42/90, 96

See application file for complete search history.

(56) References Cited

U.S. PATENT DOCUMENTS

| | | | |
|---|---|---|---|
| 4,934,085 | A | 6/1990 | Lough |
| 5,826,363 | A | 10/1998 | Olson |
| 6,421,946 | B1 | 7/2002 | LoRocco |
| 6,725,594 | B2 | 4/2004 | Hines |
| 6,836,990 | B2 | 1/2005 | Shiloni |
| 6,895,708 | B2 | 5/2005 | Kim et al. |
| D508,726 | S | 8/2005 | Storch |
| 7,117,625 | B2 | 10/2006 | Pikielny |
| 7,430,828 | B2 | 10/2008 | Munst |
| 7,438,430 | B2 | 10/2008 | Kim |
| 7,441,918 | B2 | 10/2008 | Kim |
| 7,562,483 | B2 | 7/2009 | Hines |
| 2003/0074822 | A1 | 4/2003 | Faifer |
| 2003/0106252 | A1 | 6/2003 | Hines |
| 2004/0064994 | A1 | 4/2004 | Luke |
| 2009/0038198 | A1 | 2/2009 | Yu |
| 2009/0241397 | A1 | 10/2009 | Fitzpatrick |
| 2010/0236124 | A1 | 9/2010 | Troy |

*Primary Examiner* — Bret Hayes
*Assistant Examiner* — Michael D David
(74) *Attorney, Agent, or Firm* — Swanson & Bratschun, L.L.C.

(57) ABSTRACT

A panel system for covering a lengthwise segment of an elongate firearm mounting rail. The panel system comprises at least one pair of identically shaped panel halves. Each panel half comprises a body having a top, a bottom, an abutting proximal edge and a distal edge. At least one axial tongue extends from the abutting proximal edge and a corresponding axial groove having a groove mouth is defined in the body. A cantilevered clip extends from the abutting proximal edge. A clip receptacle is defined by the body. A proximally extending lip extends from the body bottom near the distal edge. Each panel half is configured so that with the abutting proximal edges brought into abutment, each axial tongue of each panel is received in a corresponding axial groove of the other and each cantilevered clip engages the clip receptacle of the other.

17 Claims, 4 Drawing Sheets

RAIL COVER PANEL FOR A FIREARM

RELATED APPLICATIONS

This application is a continuation of U.S. patent application Ser. No. 12/359,096, filed Jan. 23, 2009, which claims priority from U.S. Provisional Patent Application Ser. No. 61/023,541, filed Jan. 25, 2008, each entitled "Rail Cover Panel for a Firearm," each of which is hereby incorporated by reference.

TECHNICAL FIELD

Firearms, and more particularly, a modular rail cover panel for a firearm mounting rail.

BACKGROUND

Modern firearms, in particular, military assault rifles, can be deployed for a number of combat missions such as sniper weapons and in close combat. They are commonly used for nighttime combat. These applications can require fitting a variety of telescopic sites, infrared sites, tactical lights, laser sighting modules, grenade launchers, bipods and other accessories to the firearm. For mounting purposes, standardized mounting platforms have been developed. One such platform is known as a Picatinny rail, which is a standardized mounting rail. The standard was first published by the Picatinny Arsenal and carries the official title MIL-STD-1913. It is also known by a NATO designation STANAG 2324. The Picatinny rail is a cross-section shaped roughly like a wide T with the top of the T corresponding to the top of the rail. The rail has a number of evenly spaced transverse slots in the top spanning the width of the T-shaped cross-section. The Picatinny rail the transverse slots or "locking slots" have a standard width of 0.206 inch (5.2324 mm) and the spacing of the slot centers is 0.394 inch (10.0076 mm) with a slot depth of 0.118 inch (2.9972 mm).

Such rails are often placed directly on the weapon's receiver, in the position normally occupied by the rear sights. The rail may also extend over rifle hand guards associated with the rifle barrel. Mounting rails such as Picatinny rails were originally used for telescopic sights and were originally found only on larger caliber rifles. With the prevalence of night vision devices, they started to appear on smaller assault rifles as well, to the point today where they are displacing iron sights used on older weapons and now sights are provided that can be mounted on the rails. In addition to top mounting rails, firearms may now include rails fastened to guns in various locations. In some cases, grips are surrounded with top, bottom and side rails. Mounting rails are also appearing on shotguns and pistols.

While the mounting rails have obvious utilitarian benefits, they are not without some shortcomings. Most notably, they can be uncomfortable when grasped by a user's hands and may under certain field conditions become clogged with dirt and other debris that make it difficult to install one of the many accessories receivable on the rails. To address these problems, a number of rail covers have been developed. One form of rail cover is designed to embrace the top of the T and be slid onto the rail lengthwise. Among the problems with such a rail cover is it can be difficult to slide onto longer rails due to the inherent friction. In addition, if there is debris lodged in the rail slots this can interfere with sliding this type of rail cover on. While in many instances such rail covers can be cut to a select length, this is an extra step making such rail covers more incontinent to use. Finally, such rail covers are typically formed as a single elongate piece of only one color, which is not optimum for a camouflage effect.

Flexible mounted panels generally work better than the slide-on type since they do not have to slide down the entire length of rail. Instead they are mounted by engaging one end of the flexible panel over an end of the T and then engaging the other end of the panel with the other end of the T. One advantage of this form of mounting is that sights and lasers which require precise alignment do not have to be removed and recalibrated when reconfiguring modular weapons and panels. Additionally, they can be more easily customized for length to fit specific areas of rail which need protection or are useful for grasping. However, since flexibly-mounted panels are somewhat pliable, they can be affected negatively by temperature extremes. In elevated temperatures such as desert warfare conditions, flexible panels may become too soft to be effectively retained by the rail. That is, they may shift or fall off under heavy operational use. This problem is exacerbated when flexible panels are cut to shorter custom lengths. Lowered temperatures can cause stiffness and brittleness which may not allow panels to be effectively mounted or removed without damage.

The modular rail cover panel for a firearm disclosed and claimed herein is intended to overcome one or more of the problems discussed above.

SUMMARY

One aspect is a panel system for covering a lengthwise segment of an elongate firearm mounting rail. The firearm mounting rail is a T rail comprising a T-shaped cross-section with the top of the T corresponding to the top of the T rail. The firearm T-rail further includes a number of transverse slots in the top spanning the length of the T-shaped cross-section. The panel system comprises a pair of identically shaped panel halves. Each panel half comprises a body having a top, a bottom, an abutting proximal edge and a distal edge. At least one axial tongue extends from the abutting proximal edge and a corresponding axial groove is defined in the body, each axial groove having a groove mouth associated with the abutting proximal edge. A cantilevered clip extends from the abutting proximal edge. A clip receiver is defined by the cover body. A proximally extending lip extends from the cover bottom near the distal edge. Each panel half is configured so that with the abutting proximal edges brought into abutment, the axial tongue of each panel is received in the axial groove of the other and the cantilevered clip engages the clip receptacle of the other.

In one embodiment an alignment post is provided extending from the cover bottom. Such an alignment post is sized to be received in a transverse slot of a firearm T-rail to which the panel mounts.

In one embodiment the proximally extending lips are configured so that with the panel halves brought into abutment in an operative position on a firearm T-rail, the proximally angled lips snugly receive the ends of the T-shaped cross-section. The proximally extending lips may each comprise at least two lip segments, with a first lip segment having a thickness less than a second lip segment and the first lip segment being proximally angled to extend further proximal than the second lip segment.

In any of these embodiments, the clip may comprise transverse lip having a beveled leading surface facilitating deflection of the cantilevered lip as the beveled leading surface strikes an abutting proximal edge of the other panel. In any of the embodiments, each panel half may be of a different color. Embodiments may include each panel half having a number of axially extending tongues greater than one and the same number of axial grooves, with each tongue received in a corresponding groove with the abutting proximal ends in abutment. The panel halves may further include ridges on the body tops which are aligned with the panel halves in abutment. The elongate firearm T-rail may be a Picatinny rail. The axial tongue may have a non-circular cross-section and the axial groove then has a mating non-circular cross-section. The non-circular cross-section may be T-shaped.

Another aspect disclosed herein is a panel system for covering a plurality of lengthwise segments of an elongate firearm rail of the type described above, which may include Picatinny rails. The panel system comprises a plurality of pairs of identically shaped panel halves in any of the various embodiments described above. For example, the panel system may include panel halves of different colors to provide a camouflage effect.

Yet another aspect is a method of covering an elongate firearm rail of the type described above, which can include Picatinny rails. The method comprises operatively associating a pair of panel halves as described in the various embodiments above by bringing the abutting edges into abutment as described above with the proximally angled lips capturing opposing ends of the T-shaped cross-section.

Another aspect is a firearm comprising an elongate firearm rail, which may be a Picatinny rail, in combination with a panel comprising any of the embodiments discussed above.

Yet another aspect is a method of making a panel in any of the embodiments as described above, wherein the panel halves are injection molded of a resilient polymer as a single integral piece.

A rail cover panel system for a firearm as described herein in its various embodiments locks the rail cover securely over the mounting T-rail of a firearm to provide a sure grip for a user. The rail cover panel can be quickly installed on a firearm simply by bringing the pieces into mating abutment in engagement with the rail top. The rail cover panels provide great flexibility as, in one embodiment, each is only about 1.5 inches in length and can thus be attached or removed as necessary to accommodate various accessories attached to the firearm rail. The rail panels can be provided in different colors to enable a camouflage effect. Furthermore, each panel half is configured to be identically shaped so that only a single mold is required for injection molding of the panel halves, minimizing tool costs and minimizing SKUs associated with the cover panels. Further advantages of the rail cover panels and rail cover panel system can be derived from review of the figures, detailed description and claims attached hereto.

DETAILED DESCRIPTION

Figure 1:
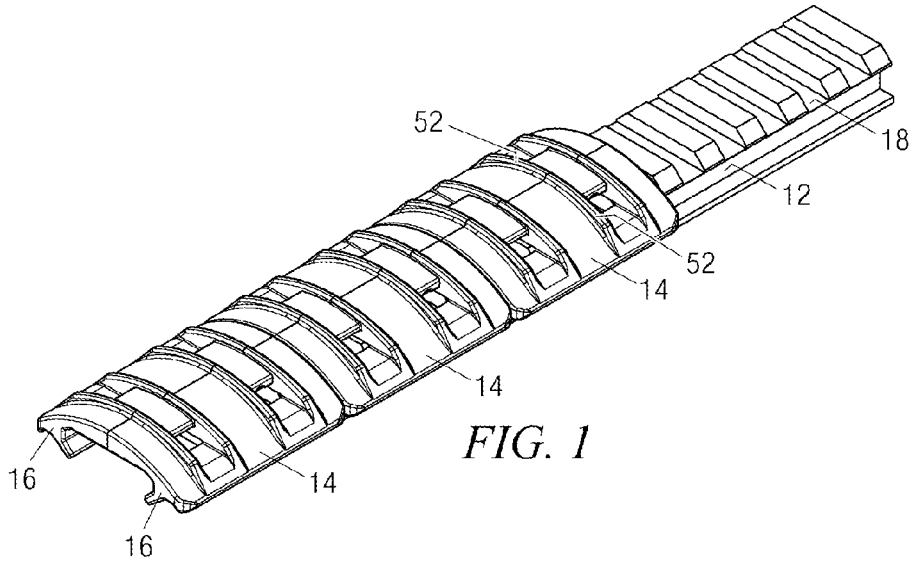
FIG. 1 is a perspective view of three assembled rail panels mounted on a T-shaped rail of a firearm with the firearm omitted for clarity.
Figure 2:
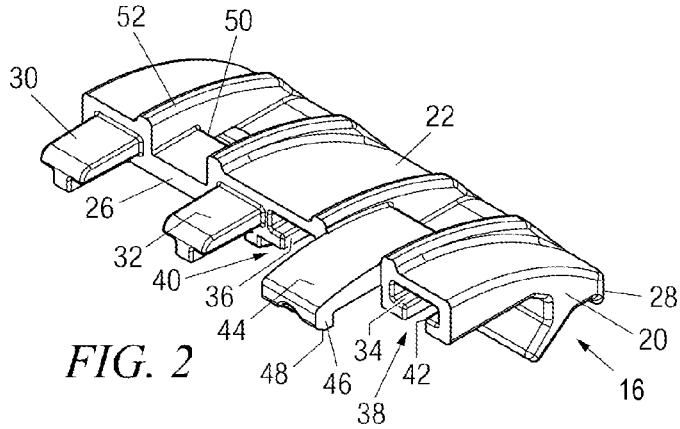
FIG. 2 is a top perspective view of a panel half of a modular rail cover panel for a firearm.

FIG. 1 is a perspective view of a Picatinny style T-shaped rail 12 of the type surrounding a rifle grip, with the rifle omitted for clarity. Depicted in FIG. 1 are a number of modular rail panels 14 comprising a rail panel system in accordance with the present invention. Each of the rail panels 14 consists of a pair of identically shaped panel halves 16.

Figure 12:
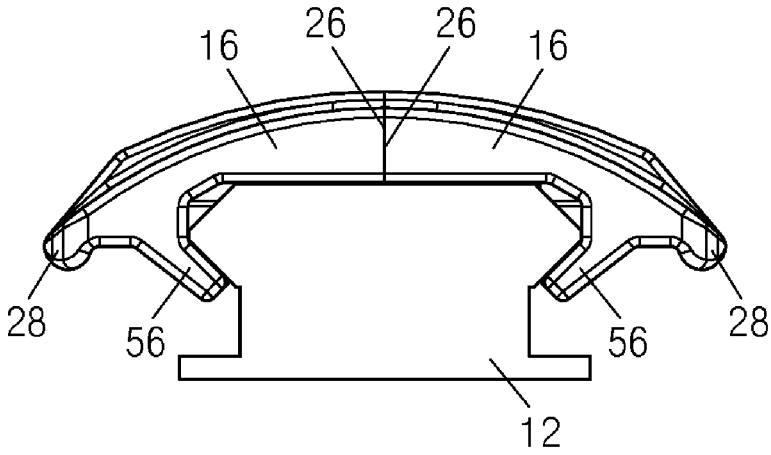
FIG. 12 is a front elevation view of an assembled rail panel on a T-shaped rail of FIG. 1.

The Picatinny rail 12 depicted in FIG. 1 can be viewed in a perspective view in FIGS. 1, 9-11 and in an elevation view in FIG. 12. The Picatinny rail has a T-shaped cross-section, with the top of the T corresponding to the top of the T-rail. A plurality of transverse slots 18 are formed in the top of the rail spanning the length of the T-shaped cross-section.

A panel half 16 is illustrated in various views in FIGS. 2-8. Each panel half comprises a body 20 having a top 22, a bottom 24 and an abutting proximal edge 26 and a distal edge 28. In the embodiment illustrated herein, first and second axial tongues 30, 32 extend axially from the abutting proximal edge 26. The axial tongues depicted herein have a non-circular cross-section, specifically, a T-shaped cross-section.

The body 20 also defines first and second axial grooves 34, 36, each having a groove mouth 38, 40 associated with the abutting proximal edge 26. Each of the first and second axial grooves 34, 36 has a non-circular cross-section corresponding to that of the tongue received therein; in this case, a T-shaped cross-section configured to receive a corresponding axial tongue 30, 32. In the embodiment illustrated herein, each of the grooves has an open slot 42 configured to receive the stem of the "T" of the axial tongues 30, 32.

A cantilevered clip 44 extends from the abutting proximal edge 26. In the illustrated embodiment, the cantilevered clip has a transverse lip 46 with a beveled leading surface 48.

The body 20 further includes a clip receptacle in the form of a shoulder 50 on the top of the body 20. A number of ridges 52 extend transverse the length of the body 20.

Figure 3:
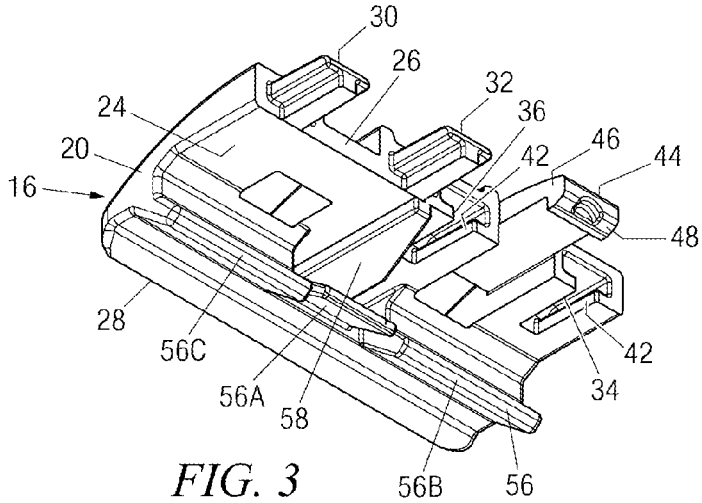
FIG. 3 is a bottom perspective view of the panel half of FIG. 2.
Figure 4:
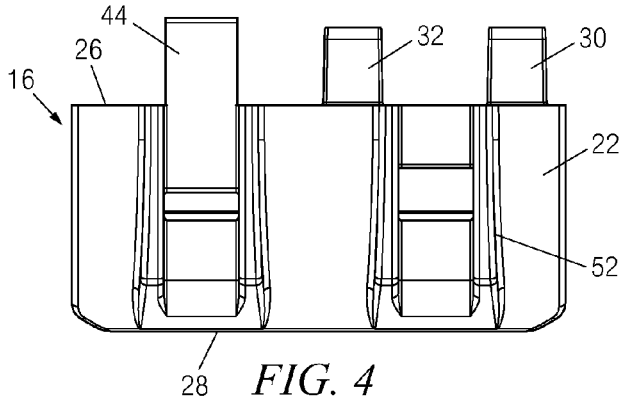
FIG. 4 is a top plan view of the panel half of FIG. 2.
Figure 5:
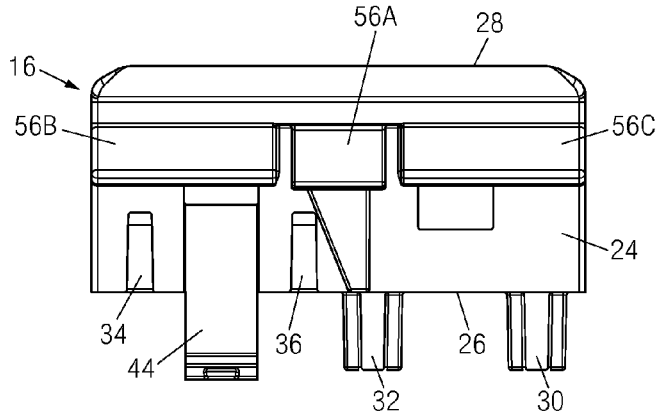
FIG. 5 is a bottom plan view of the panel half of FIG. 2.
Figure 6:
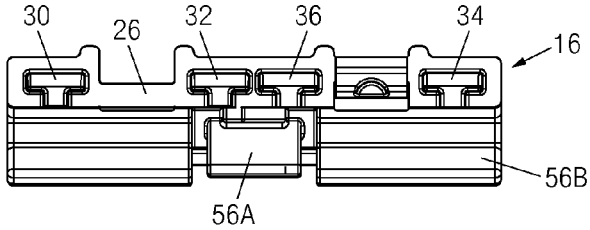
FIG. 6 is a proximal side elevation view of the panel half of FIG. 2.
Figure 7:
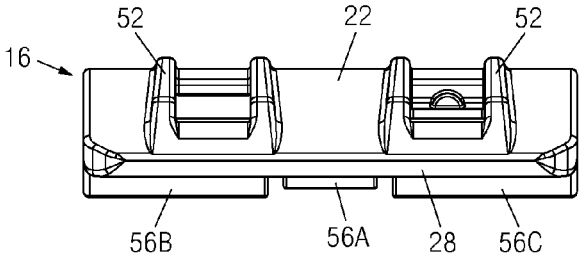
FIG. 7 is a distal side elevation view of the panel half of FIG. 2.
Figure 8:
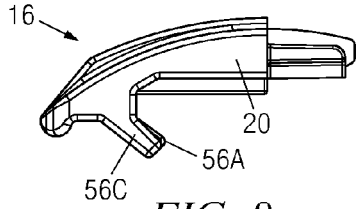
FIG. 8 is a right side elevation view of the panel half of FIG. 2.
Figure 9:
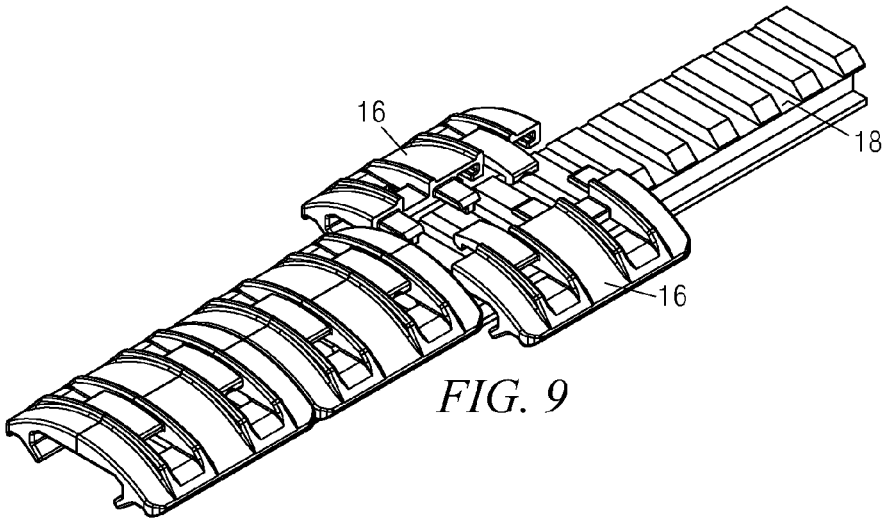
FIG. 9 is a pair of panel halves being brought into abutment in operative engagement with a T-shaped rail.
Figure 13:
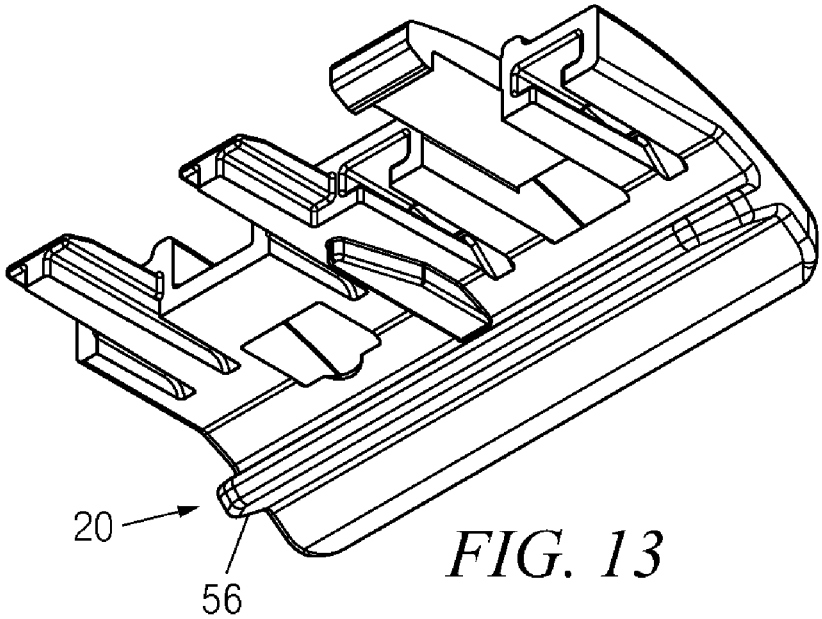
FIG. 13 is a bottom perspective view of an alternative embodiment of the panel half of FIG. 2

Referring to FIGS. 3 and 8, a proximally extending or angled lip 56 extends from the body bottom near the distal edge 28. In the illustrated embodiment, the proximally extending lip consists of three lip segments, a first lip segment 56A, a second lip segment 56B and a third lip segment 56C. In this embodiment the first lip segment 56A has a thickness less than the second and third lip segments 56B, 56C. In addition, the first lip segment 56A is proximally angled to extend further proximal than the second and third lip segments 56B, 56C. This feature is perhaps best viewed with reference to FIG. 8. Alternatively, as illustrated in FIG. 13, the proximally extending lip 56 can be a single segment.

An alignment post 58 extends from the bottom 24 of the body 20. The alignment post 58 is sized to be received in a transverse slot of a T-rail 12 such as the Picatinny rail depicted in the figures. The width of the alignment post 58 in one embodiment is just less than the width of the transverse slots in the T-shaped rail to fit snugly therein.

Figure 10:
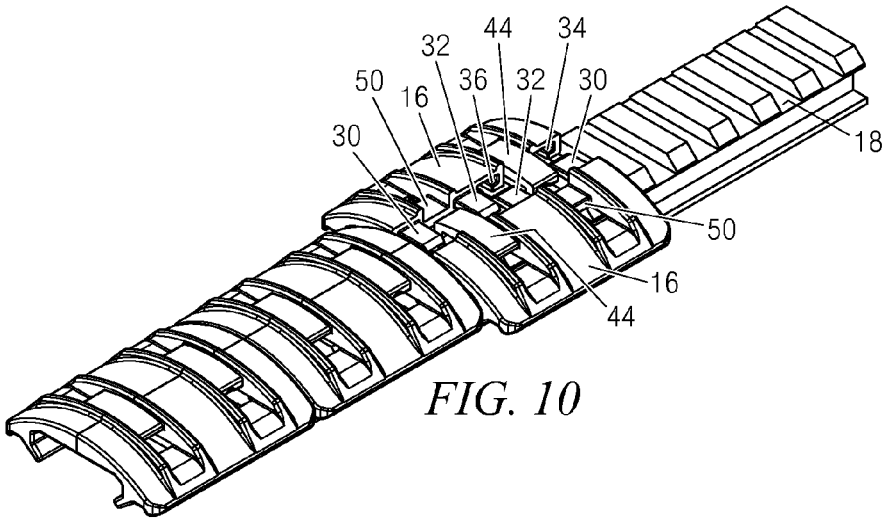
FIG. 10 shows the rail halves of FIG. 9 closer to being in abutment.
Figure 11:
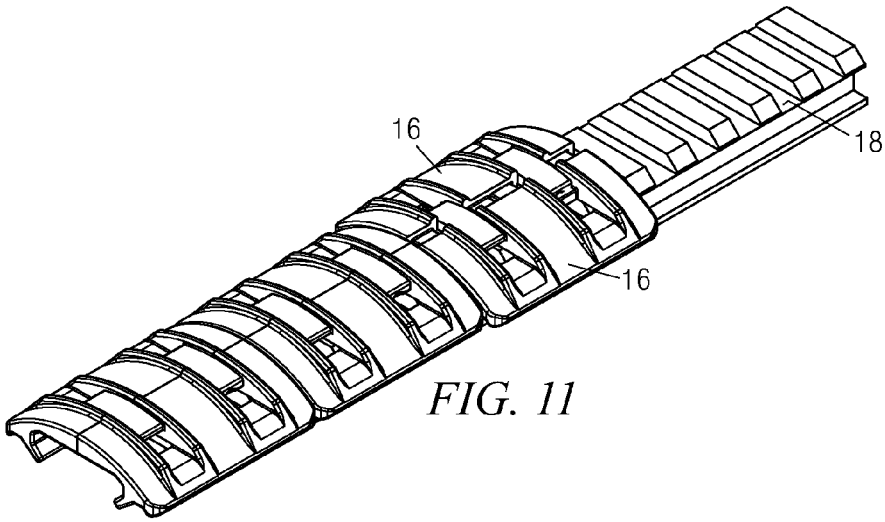
FIG. 11 shows the panel halves of FIG. 9 in partial engagement.

FIGS. 9-11 and 1 illustrate assembly of the panel halves to a completed panel in operative association with a T-shaped rail 18. Referring to FIG. 10, it can be seen that the panel halves are configured so that with the abutting proximal edges 26 of a pair of panel halves abuttingly aligned, the first and second axial tongues 30, 32 align with the first and second axial grooves 34, 36 to be axially received therein. In addition, the cantilevered clip 44 aligns with the clip shoulder 50 so that as the abutting proximal edges are brought into engagement, the transverse lip 46 engages the clip shoulder 50 to hold the panel halves in place. The beveled surface 48 of the transverse lip 46 is configured to facilitate deflection of the cantilevered clip 44 as the beveled leading surface 48 strikes an abutting proximal edge of the other panel half. Referring to FIG. 12, the lip segments 56A-C are sized and configured so that with the panel halves brought into abutment with the firearm T-rail, the proximally extending lips snugly receive the ends of the T-shaped cross-section. The first lip segment 56A, which as described above extends further proximal than the second and third lip segments 56B, 56C, can act like a spring to compensate for any tolerance gap in the manufacture of the panel halves 16 or the T-shaped rail 18. Referring to FIG. 1, with the panel halves fully engaged, the transverse ridges 52 of each half 16 are in alignment to form grip enhancing ridges along the top 22 of the body 20. With further reference to FIG. 12, the distal edges 28 preferably extend over the ends of the T-shaped rail 18.

The panel halves can be injection molded from a single mold. In addition, the panel halves can be injection molded of a resilient material to facilitate secure attachment to the T-shaped rail, as the resiliency enhances the spring effect securing the panel to the T-shaped rail. Representative resilient materials from which the panels can be made include a number of resilient polymers such as nylon, polypropylene, styrene and other synthetic organic polymers. The resilient material may include glass fiber reinforced polymers and the polymers may include impact modifiers The disclosure also encompasses all possible permutations of the claim set, as if they were multiple dependent claims.

While the invention has been particularly shown and described with reference to a number of embodiments, it would be understood by those skilled in the art that changes in the form and details may be made to the various embodiments disclosed herein without departing from the spirit and scope of the invention and that the various embodiments disclosed herein are not intended to act as limitations on the scope of the claims. All references cited herein are incorporated in their entirety by reference.

What is claimed is:

1. A panel system for covering a lengthwise segment of an elongate firearm T-rail, the firearm T-rail comprising a T-shaped cross-section, the panel system comprising:

at least one pair of panel halves, each panel half comprising:

a body having a top, a bottom, an abutting proximal edge and a distal edge; and a proximally extending lip on the body bottom near the distal edge, each proximally extending lip being configured so that with the panel halves brought into abutment in an operative position on a firearm T-rail, the proximally extending lips snugly receive the T edges of the top of the T-shaped cross-section;

each panel half being configured so that with the abutting proximal edges of a pair of panel halves brought into abutment, the panel halves releasably engage each other to define a whole panel.

2. The panel system of claim 1 further comprising each panel half having an identical shape.

3. The panel system of claim 1 further comprising an alignment post extending from each body bottom, the alignment post being sized to be received in a transverse slot of a firearm T-rail.

4. The panel system of claim 3 further comprising each alignment post being configured to be snugly received in the transverse slot.

5. The panel system of claim 1 wherein each proximately extending lip comprise at least two lip segments, with a first lip segment having a thickness less than a second lip segment and the first lip segment being proximally angled to extend further proximal than the second lip segment.

6. The panel system of claim 1 further comprising at least one panel half being a different color.

7. The panel system of claim 1 further comprising each panel half comprising an at least one axial tongue extending from the abutting proximal edge and an axial groove corresponding to each axial tongue, each axial tongue being configured to be received in a corresponding axial groove with the abutting proximal edges brought into abutment.

8. The panel system of claim 7 wherein each axial tongue has a non-circular cross-section and each axial groove has a mating non-circular cross-section.

9. The panel system of claim 8 wherein each axial tongue has a T-shaped cross-section.

10. The panel system of claim 1 wherein the elongate firearm T-rail is a Picatinny rail.

11. The panel system of claim 1 comprising a plurality of pairs of panel halves.

12. The panel system of claim 1 comprising panel halves of a variety of colors which are paired according to user preference.

13. The panel system of claim 1 wherein the distal edge is configured to extend over the T edges of the top of the T-shaped rail when operatively attached thereto.

14. The panel system of claim 1 wherein each panel half is injection molded of a resilient polymer.

15. The panel system of claim 14 wherein each panel half is injection molded in a single mold.

16. The panel system of claim 1 further comprising:

a cantilevered clip extending from the abutting proximal edge; and a mating clip receptacle defined in the body, the cantilevered clip and the mating clip receptacle being configured so that with the abutting edges of panel halves in abutment, the cantilevered clip of one panel half releasably engages the mating receptacle of another panel half.

17. A firearm comprising:

a firearm T-rail comprising a T-shaped cross-section; and a panel cover, the panel cover comprising:

at least one pair of panel halves, each panel half comprising:

a body having a top, a bottom, an abutting proximal edge and a distal edge, each proximally extending lip being configured so that with the panel halves brought into abutment in an operative position on a firearm T-rail, the proximally extending lips snugly receive the T edges of the top of the T-shaped cross-section; and a proximally extending lip on the body bottom near the distal edge;

each pair of panel halves being configured so that with the abutting proximal edges brought into abutment, the panel halves releasably engage each other to define a whole panel.

* * * * *